United States Patent [19]

Barker

[11] Patent Number: 5,040,835

[45] Date of Patent: Aug. 20, 1991

[54] SECURITY BAR LOCK

[76] Inventor: Charles Barker, Rte. 3 Box 37C, Calhoun City, Miss. 38916

[21] Appl. No.: 574,896

[22] Filed: Aug. 30, 1990

[51] Int. Cl.[5] ..... E05C 17/44

[52] U.S. Cl. ..... 292/338

[58] Field of Search ..... 292/338, 339, 362, 259, 292/265, 268, 271, 272

[56] References Cited

U.S. PATENT DOCUMENTS

| | | | |
|---|---|---|---|
| 1,810,186 | 6/1931 | Richards . | |
| 1,847,705 | 3/1932 | Yorger | 292/338 |
| 1,879,119 | 9/1932 | Dauble . | |
| 1,944,783 | 1/1934 | Ciriacy et al. . | |
| 1,966,612 | 7/1934 | Cochran . | |
| 4,456,291 | 6/1984 | Brogie . | |
| 4,822,086 | 4/1989 | Brown . | |

FOREIGN PATENT DOCUMENTS

| | | | |
|---|---|---|---|
| WO/80/009-87 | 5/1980 | European Pat. Off. | 292/338 |
| 630304 | 4/1927 | France | 292/338 |

*Primary Examiner*—Robert L. Wolfe

*Attorney, Agent, or Firm*—Dowell & Dowell

[57] ABSTRACT

A security bar lock for entry doors which includes an elongated rod member having one end which is selectively braced against a floor and an opposite end which is removably mounted within and slidably retained by a door mounted keeper so that a limited opening of the door is permitted when the lock is installed and wherein the elongated rod member may be selectively detached from the keeper when the lock is not in use.

6 Claims, 1 Drawing Sheet

13
15
16
23
17
27
24
25
21
12
11
31
18
20
19
22
14
K
D
30
F
33

D
11
22
12
30
R
31
R
30

31
30
32

5
13
D
16
17
24
25
21
22
5
D
21
22
11
30
31
18

D
16
27
11
26
21
19
12

12
31
11
26
30

22
12
31
30
31
30
26
11

30
12
27
22
26
11
31

SECURITY BAR LOCK

BACKGROUND OF THE INVENTION

1. Field of the Invention

This invention is generally directed to locking devices for entry doors such as doors opening into a residence or an apartment and more specifically to security bar locks of the type having an elongated rod having one end attached to a keeper that is mounted to the rear of the door in spaced relationship with respect to the floor and wherein the other end of the rod or extension member acts as a brace when the lower end is abutted against the floor or an abutment member mounted to the floor.

2. History of the Related Art

There have been many attempts to provide security locks for use on entry doors so as to prohibit the unauthorized opening of the doors. As demands grow for increased security many individuals have begun supplementing the common doorknob type of entry lock with other types of locks including dead bolt mechanisms which are mounted to the door frame and which cooperate with sliding locks carried by the door. Some problems with the use of supplemental locks having components which are mounted to a door frame are that additional sets of keys are necessary for each of the separate locking mechanisms and such locking mechanisms may be bypassed by tampering with the door frame and therefore the amount of security provided is directly dependent upon the strength of the door frame.

Another problem with locking mechanisms between a door and a door frame is that generally the locks operate only to retain the door in a closed position relative to the door frame. In some instances, it may be necessary for an individual to open a door a limited amount to determine the identity of the individual seeking entry. To provide limited security in these events conventional use is normally made of a chain attachment which extends from a keeper mounted o the door frame to a secondary keeper mounted on the back of the door. Unfortunately, chain-like restraint devices are easily bypassed, either by manipulation of the chain relative to the keepers, by placing force on the door to withdraw the keepers from the door frame or by tampering with the chain directly such as by cutting the chain in order to gain entry. In view of the foregoing problems and the continuing desire to provide for increased security many attempts have been made to provide for special bracing mechanisms which are mounted to the rear of the door and which are braced against the floor. Such bracing mechanisms offer a benefit over conventional door frame mounted locks in that the braces cannot be easily accessed by an individual trying to obtain unlawful or unauthorized entry. Further, the braces are not dependent upon the strength of the door frame but rather transfer force directly to the floor and its underlying supports which are designed to withstand a great deal more force that are conventional door frames.

Conventional brace-type door jams or locks generally include a keeper element which is attached to the door generally in spaced relationship with respect to the floor and in which keeper element is pivotally mounted one end of a brace rod or extension member. The opposite end of the brace rod or extension member includes a foot portion which may include a of friction plate that is engaged with the floor or may include a portion which is engageable with an abutment member attached to the floor. In this manner, when the brace rod is lowered into a position wherein the door is locked relative to the door frame any attempt to open the door will cause force to be transmitted along the length of the rod whereby the floor will absorb the energy of the force being applied. The greater the amount of force applied to the door the tighter the brace becomes. When it is desired to open the door it is only necessary to raise the brace rod relative to the floor. In many conventional brace-like door locks retainers are provided for retaining the brace rods in an elevated position when not in use.

Unfortunately, there are drawbacks associated with most conventional brace-type security door locks. As with many dead bolt-type door locks, which are attached to a door frame, most brace-type security door locks do not permit any opening of the door when the braces associated with such locking mechanisms are in place. Therefore, it is not possible for a person to secure a door in a partially opened position when opening the door to determine if a person seeking entry is an authorized individual. Another drawback with conventional brace-type door locks is that the locks can be manipulated by children after adults have left the premises. Under such circumstances it is possible for a child to lock themselves within an area while preventing the adult from regaining entry. This situation cannot only be emotionally disturbing for a child who is locked within an area, but could be potentially hazardous for a child in the event some occurrence were to take place in which entry into the area was absolutely necessary, such as in the case of fire.

Other problems inherent with conventional brace-type door locks are that the mechanisms tend to be mechanically difficult and therefore expensive to purchase and install. Many brace-type door locks include complicated ratchet adjustments or telescoping members which all must be adjusted for a given installation. The more complicated the locking mechanism is to use or to install the less likely it is that the locking mechanism will be utilized by the individual for which the mechanism has been provided.

In view of the foregoing, it is necessary to provide a brace-type locking mechanism which provides the benefit of increased strength which also allows for a limited opening of a door to determine the identity of an individual seeking entry or to allow for limited ventilation, as well as to provide a locking mechanism which is cost efficient and easy to install and one which can be easily dismantled so that the lock may not be utilized by children when an adult is not present within a given area.

Some examples of prior art door brace restraints or locks are disclosed in U.S. Pat. Nos. 1,810,186 to Richards; 1,879,119 to Dauble; 1,944,783 to Ciriacy et al.; 1,966,612 to Cochran; 4,456,291 to Brogie; and 4,822,086 to Brown.

SUMMARY OF THE INVENTION

This invention is directed to a security bar lock which functions as a door brace and which is specifically designed for use with entry way doors and which is designed to brace the door against a floor to thereby prevent the unauthorized opening of the door but which does provide for a limited opening of the door to determine the identity of an individual seeking access. The lock includes a keeper having a base portion which is mounted to the door and which is defined having a pair of vertically oriented guide slots having upper and lower ends which are separated by an open channel. A first groove is provided adjacent the lower ends of the guide slots and an elongated rod member is provided having a T-shaped upper end which is alignable with the channel when in a first position and, as the rod is rotated, will become seated within the vertical guide slots. The lower end of the rod is designed to be engageable with the floor and may be seated within a socket member which is mounted flush with the floor when the brace is in use to provide a locking mechanism for the door.

In a preferred embodiment, the rod inserting channel of the keeper is defined having upper and lower ends with side walls defining the upper ends. The sidewalls are tapered so that when the rod member is pivoted to a non-use position wherein the lower end is generally parallel with the door and spaced above the upper end thereof, the rod will be frictionally engaged between the side walls defining the slot thereby retaining the rod member in an out-of-use position. Further, an additional groove is provided along the upper portion of the guide slots to provide for secure seating of the T-shaped upper end of the rod member when the upper end is moved from the lower ends of the guide slots to the upper ends thereof.

It is the primary object of the present invention to provide a brace-type security door lock having a keeper which is mounted to the rear surface of a door generally in an area adjacent the doorknob and which is provided with a pair of guide slots having upper and lower ends wherein a rod member having an upper end slidable within the guide slots may be adjusted within the slots so that when the upper end of the guide rod is in a first position adjacent the lower end of the slots the door will be retained in a closed position but when the upper end of the rod member is urged to the upper portion of the guide slots the door may be opened a distance determined by the length of the slots to thereby allow a limited but secure opening of the door.

It is also an object of the present invention to provide a brace-type security door lock which includes a keeper mounted to the rear of the door and a brace rod member which is engageable relative to the floor and which includes an upper end mounted within the keeper member and wherein the rod member may be simply removed from the keeper member by a relative rotation of the rod to the keeper to thereby prevent the unauthorized use of the locking mechanism.

It also an object of the present invention to provide a brace-type security door lock which requires only two major components and which is therefore easy to install and use.

BRIEF DESCRIPTION OF THE DRAWINGS

FIG. 7 is a front elevational view of the keeper mechanism of the present invention illustrating the rotational movement of the T-shaped end portion of the brace rod as it is installed relative to the keeper.

DESCRIPTION OF A PREFERRED EMBODIMENT

Figure 1:
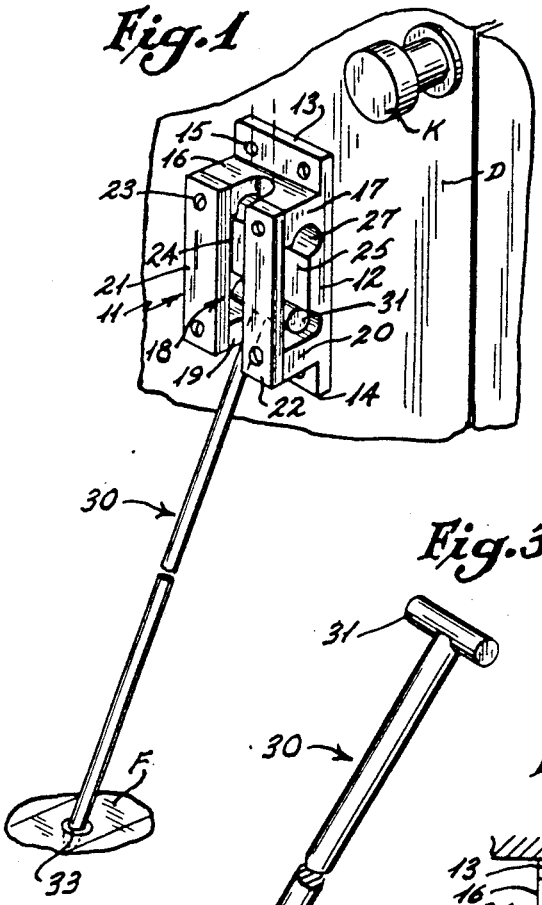
FIG. 1 is a perspective view of the security door lock of the present invention as it is installed relative to the rear of the door adjacent the doorknob with the brace rod member being shown as seated within a socket mounted flush with the surface of a floor.

With continued reference to the drawings, the security bar lock 10 of the present invention includes a keeper member 11 having a base portion 12 which is adapted to be mounted to an entryway door (D) generally in the area adjacent the conventional doorknob (K). In the embodiment shown in the drawings, the base member 12 includes upper and lower flange portions 13 and 14 having openings therein through which screws 15 may be inserted so as to secure the base to the door. The base member also includes a first pair of integrally formed spacer members 16 and 17 which define a portion of a U-shaped channel 18 therebetween. A pair of lower integrally formed spacer members 19 and 20 define another portion of a U-shaped channel 18 therebetween.

A pair of retention members 21 and 22 are mounted between the extension members 16, 19 and 17, 20, respectively, so as to be aligned on either side of the channel 18. The retention members are secured to the spacer members by screws 23. With the retention members in place a pair of vertically oriented guide slots 24 and 25 are defined therebetween on either side of the channel 18. Although the invention is described as having separate retention plates 21 and 22 which are selectively secured to the base portion 12, it is possible that the retention plates may be cast or molded as an integral unit with the base portion thereby not requiring the use of the screws 23 to secure the plates relative to the base.

Figure 2:
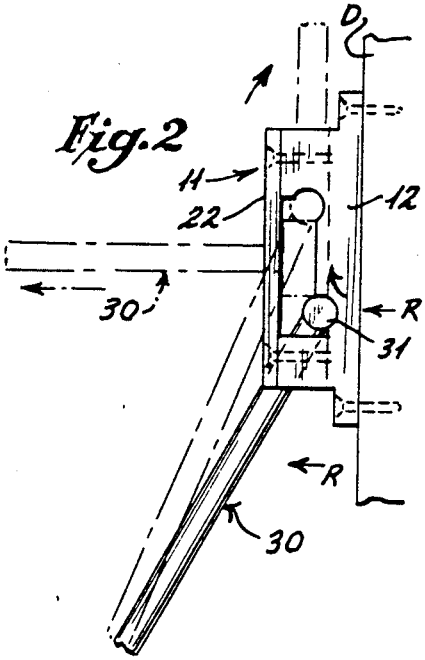
FIG. 2 is a left side elevational view of the keeper mechanism shown in FIG. 1 attached to the door showing the selective movement of the upper end of the brace rod member from a lower completely locked position to an upper dotted line position wherein the door may be opened a matter of inches but retained in a braced condition. The drawing further shows in dotted line the further pivoting of the brace rod member to a full vertical position or non-use position.
Figure 3:
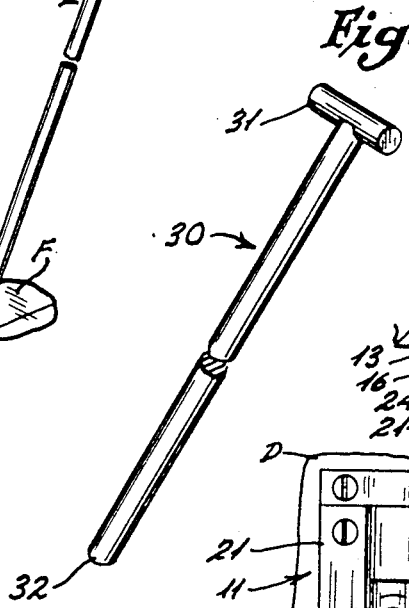
FIG. 3 is a perspective view of the brace rod associated with the security door lock of the present invention.
Figure 4:
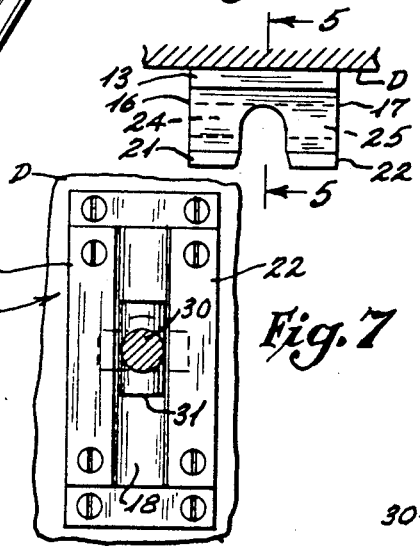
FIG. 4 is a top plan view of the keeper mechanism of the security door lock of the present invention.
Figure 5:
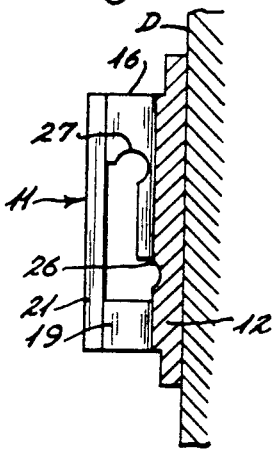
FIG. 5 is a cross-sectional view taken along lines 5—5 of FIG. 4.
Figure 6:
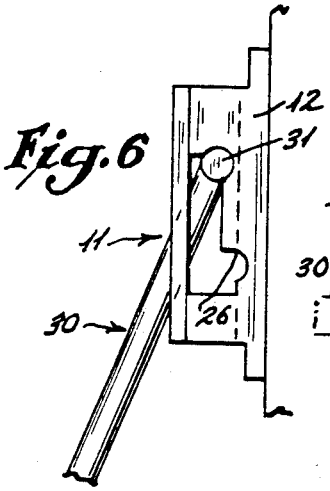
FIG. 6 is side elevational view showing the security door lock mechanism of the present invention with the brace rod in a position to permit limited opening of the door.
Figure 8:
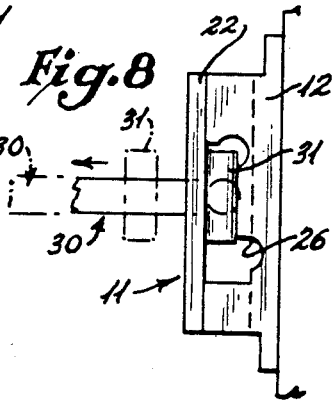
FIG. 8 is a side elevational view of the keeper mechanism of the present invention showing the T-shaped end of the brace rod member as it is aligned to be withdrawn from the keeper member.

With particular reference to FIG. 2, a first generally horizontal groove 26 is provided adjacent the lower end of the guide slots 24 and 25 while a second horizontal groove 27 is provided in the base adjacent the upper portion of the guide slots 24 and 25. Each of the first and second grooves is in open communication with the guide slots for purposes of which will be discussed in greater detail hereinafter. It should be noted that the groove 26 is substantially greater in depth dimension than groove 27.

The security bar lock 10 also includes an elongated bracing bar or rod 30 having an upper end 31 in the configuration of a "T" and a lower end 32. In use, the lower end 32 is designed to abut a member mounted on the floor or may include a friction boot which will be selectively engaged with the floor. In the preferred embodiment, an opening is made in the floor (F) rearwardly of the door with a socket member 33 being placed therein so as to be substantially flush with the surface of the floor. In use, the lower end 32 of the bracing rod is inserted within the socket and retained therein so that any force placed upon the bracing rod when in use will be imparted to the floor. The upper T-shaped end 31 of the bracing rod is designed to be received through the channel 18 of the keeper as shown in full line in FIG. 7 and thereafter, upon rotation of the bracing rod, the T-shaped end 31 will be seated within the guide slots 24 and 25. Therefore, the width of the channel 18 is slightly greater than the width or cross-sectional dimension of the T-shaped end of the rod 30, at least along the majority of the length of the channel.

As the bracing bar or rod is designed to be selectively positioned within the keeper 11, whenever it is necessary to remove the bracing bar from the security bar lock it is only necessary to elevate the lower end portion 32 of the bracing rod and thereafter rotate the rod so that the T-shaped end 31 aligns with the channel 18 thereby permitting the rod to be withdrawn from the keeper. In this manner, it is possible to prevent the unauthorized use of the bar lock of the present invention which may be necessary especially if young children are briefly being left alone without adult supervision.

Figure 9:
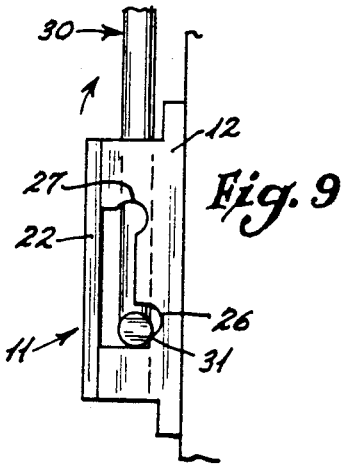
FIG. 9 is a side elevational view of the security locking mechanism of the present invention wherein the brace rod is raised to a non-use position relative to the keeper mechanism.

In other instances, when the bar lock is not in use but the bracing rod 30 is not to be removed from the keeper, the bracing rod may be stored in a vertically elevated position such as shown in dotted line in FIG. 2 and in full line in FIG. 9. Therefore, when it is not desired to use the bracing rod 30 the rod is rotated as indicated by the arrow in FIG. 2 until the lower end 32 is in generally parallel relationship with the door (D) and above the T-shaped end 31. In this position, the T-shaped end will be seated in the bottom of the guide slots adjacent the groove 26. In order to retain the rod in vertical position, the walls between the extension members 16 and 17 which define the upper portion of the channel 18 are bevelled slightly so that the dimension of the channel adjacent the upper portion of the keeper is just slightly less than the cross-sectional dimension of the bracing bar 30. Therefore, as the bar is raised and forced within the upper portion of the channel 18 the bar will be frictionally retained therein by the opposing walls of the extension pieces 16 and 17.

As previously discussed, one of the benefits of the security bar lock 10 of the present invention is that when in place, it allows the door to be either totally closed and reinforced or partially opened and reinforced thereby allowing an individual to open the door partially, either to have articles passed therethrough, to identify someone seeking entrance, or to provide for ventilation without yielding the security of having the door braced to prevent its full opening.

In order to accomplish the above, when the bracing rod 30 is in its fully locked position thereby bracing the door in a closed relationship with respect to its frame, the T-shaped upper end 31 will be seated in the lower deep groove 26 adjacent the lower end of the guide slots 24 and 25. The depth of the groove 26 is sufficient to prohibit the accidental displacement of the T-shaped end 31 of the bracing rod unless intentional force is directed to pull the T-shaped end outwardly of the groove 26 and into the guide slots 24 and 25. With respect to FIG. 2 of the drawings, if pressure is urged in the direction of the arrow (R) shown in the drawing, the T-shaped end 31 of the bracing rod may be disengaged from the groove 26 as shown in dotted line. Once removed from the groove the door will be free to open by an extent determined by the length of the guide slots 24 and 25. As shown in dotted line in FIG. 2, as the door is opened the T-shaped upper end of the bracing rod will ride along the guide slots 24 and 25 until it seats within the upper groove 27 associated therewith. At this point, the door will be prohibited from further opening and the guide rod 30 will continue to brace door and maintain it in its partially opened position. Any attempt to put additional pressure on the door to open the same will merely increase the amount of force directed along the bracing rod 31 with the force being counteracted by the floor (F) due to the engagement of the lower end 32 of the bracing rod within the socket member 33. When it is desired to return the door to its fully closed position it is only necessary to push the door towards the door frame at which time the upper end 31 of the bracing rod 30 will automatically slide down the guide slots 24 and 25 until the upper end 31 seats in the enlarged groove 26 at the same time that the door latches with its conventional latch mechanism.

It is preferred that the security lock mechanism of the present invention be constructed of a lightweight aluminum-type alloy, although other metallic materials may be utilized. In some instances, it may be possible to use high impact plastic materials to form the components of the invention.

I claim:

1. A security bar lock for an entryway door which is designed to brace the door against a floor to thereby prevent the unauthorized opening of the door, the bar lock comprising, a rigid keeper having a base portion, means for mounting said base portion to the door, a pair of spaced vertically oriented guide slots formed in said keeper, said guide slots having upper and lower ends, a first groove formed in said base plate and communicating with said guide slots adjacent said lower ends thereof, an opened channel formed between said guide slots, said channel having upper and lower ends, an elongated rod member having upper and lower ends, said lower end of said rod member being selectively engagable relative to the floor, said upper end of said rod member being selectively seated within said guide slots, said upper end of said rod member being T-shaped and of a size to be inserted within said channel when aligned axially therewith and thereafter, as said rod member is rotated, to be receivable and retained within said guide slots with said elongated rod member extending through said channel, said T-shaped upper end of said rod member being selectively seated within said first groove to thereby retain the door braced closed in a first position, said first groove being of a dimension to normally retain said T-shaped upper end of said rod member therein, said T-shaped upper end being selectively seated adjacent said upper ends of said guides slots whereby said security bar lock permits a limited opening of the door while bracing the door from complete opening.

2. The security bar lock of claim 1 in which said open channel is defined by opposing side walls adjacent said upper end thereof, said side walls being spaced relative to one another by a distance which is slightly less than the cross-sectional dimension of said elongated rod member, said rod member being frictionally retained between said side walls when said rod member is pivoted so that said lower end thereof is substantially parallel relative to the door and positioned above said upper T-shaped end thereof.

3. The security bar lock of claim 1 including a second groove formed in said base plate and communicating with said guide slots adjacent said upper ends thereof.

4. The security bar lock of claim 3 including an abutment member which is secured to the floor in spaced relationship to the door, said lower end of said rod member being selectively engageable with said abutment member.

5. The security bar lock of claim 4 in which said abutment member is a socket seated within the floor so as to be flush therewith.

6. A security bar lock for entryway doors which is designed to brace a door against the floor to prevent the unauthorized opening of the door, the bar lock comprising, a keeper having a base portion and a pair of spaced rigid retention members mounted thereto, means for mounting said base portion to the door, a pair of spaced vertically oriented guide slots formed between said base portion and said retention members, said guide slots have upper and lower ends, a first horizontal groove formed in said base plate and communicating with said guide slots adjacent said lower ends thereof and a second horizontal groove forward of said base plate and communicating with said guide slots adjacent said lower ends thereof, an open channel formed between said retention plates and communicating with said guide slots, said channel having upper and lower ends, an elongated rod member having upper and lower ends, said lower end of said rod member being selectively engageable relative to the floor, said upper end of said guide member being selectively seated within said guide slots, said upper end of said rob member being T-shaped and of a size to be inserted within said channel when aligned therewith and thereafter, as said rod member is rotated, to be receivable within said guide slots so as to be retained therein by said retention plates with said elongated rod extending through said channel, said T-shaped end of said rod member being selectively seated with said first horizontal groove to retain the door in a fully closed position, said first groove being of a dimension to normally retain said T-shaped upper end of said rod member therein, said T-shaped end of said rod member being shiftable to be selectively seated within said second horizontal groove to permit the door to be opened to a second position whereby said security bar lock permits a limited opening of the door while bracing the door from complete opening.

* * * * *